US006277039B1

(12) United States Patent
Kleinschrodt

(10) Patent No.: US 6,277,039 B1
(45) Date of Patent: Aug. 21, 2001

(54) BALL-CAPTURING TENNIS NET ASSEMBLY

(76) Inventor: Leigh Taylor Kleinschrodt, 5396 Spring Hill Woods Dr., Mobile, AL (US) 36608

( * ) Notice: Subject to any disclaimer, the term of this patent is extended or adjusted under 35 U.S.C. 154(b) by 0 days.

(21) Appl. No.: 09/372,272

(22) Filed: Aug. 11, 1999

Related U.S. Application Data

(60) Provisional application No. 60/096,447, filed on Aug. 13, 1998.

(51) Int. Cl.[7] ..... A63B 69/38
(52) U.S. Cl. ..... 473/460; 473/492; 473/495
(58) Field of Search ..... 473/460, 469, 473/490, 492, 493, 494, 495

(56) References Cited

U.S. PATENT DOCUMENTS 4,886,268 * 12/1989 Langalet .
4,919,421 * 4/1990 Vandeveld .

* cited by examiner

*Primary Examiner*—William M. Pierce

(57) ABSTRACT

This invention comprises a ball-capturing tennis net assembly designed to be used in combination with existing court structures for catching balls which strike the standard tennis net. The catch-net extends under or is attached to the bottom of the standard tennis net forming two sides. Each side protrudes upwards at an angle near 45 degrees and is held in place by brackets. At least one end bracket is mounted to each of the standard net posts and functions to hold the top of the two sides of the catch-net parallel to and at a desired width from the standard tennis net. The end brackets hold the bottom of the catch net tightly around the bottom of the standard tennis net. At least two middle brackets, which when assembled form a center spacer unit, are located between the two net posts to help hold the catch-net open in a v-shaped position under and onto each side of the court divided by the standard tennis net. The catch-net is also designed to receive and hold the middle brackets in position. The height of the catch-net is substantially lower than the standard tennis net height in order to catch a maximum number of balls. This novel v-shaped design helps to dampen the velocity of the tennis balls hit into the net and helps to prevent them from bouncing out. This catch-net is intended to be used for instructional, recreational, and competitive tennis.

13 Claims, 5 Drawing Sheets

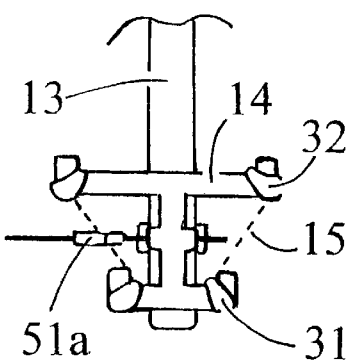
Figure 8
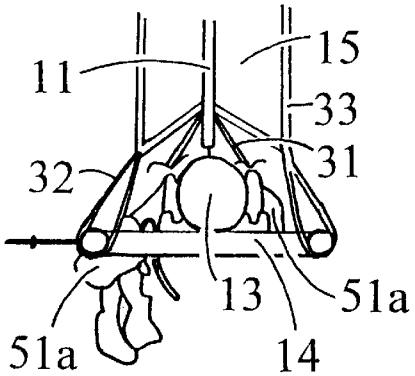
Figure 9
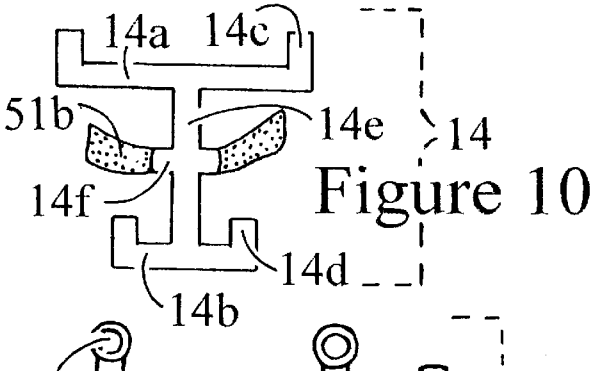
Figure 10
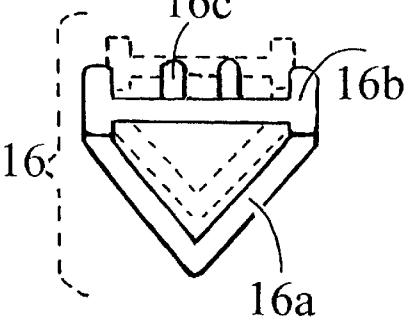
Figure 11
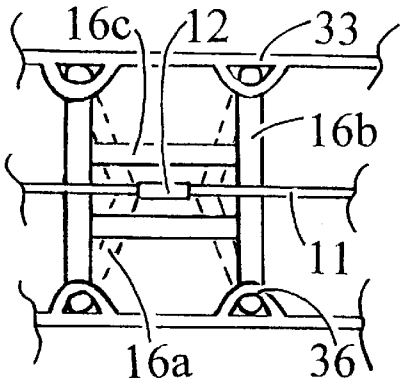
Figure 12
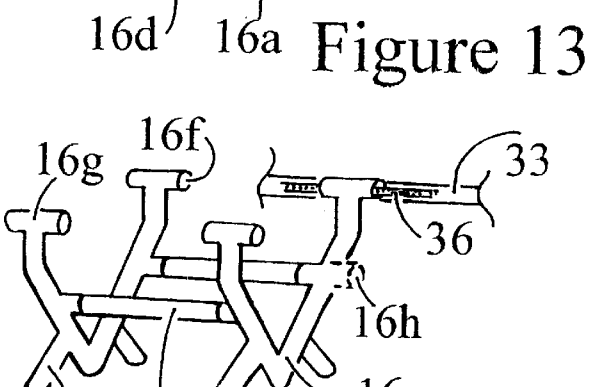
Figure 13
Figure 14

BALL-CAPTURING TENNIS NET ASSEMBLY

CROSS-REFERENCE TO RELATED APPLICATIONS

This patent is a continuation of Provisional Patent: Pat. No. 60/096,447 having a filing date of Aug. 13, 1998.

STATEMENT REGARDING FEDERALLY SPONSORED RESEARCH AND DEVELOPMENT

Not Applicable.

REFERENCE TO A MICROFICHE APPENDIX

Not Applicable

BACKGROUND OF INVENTION

1. Field of Invention

This invention relates to tennis net ball-catchers. More particularly the invention involves a novel design of a ball-capturing tennis net assembly which works in conjunction with a standard tennis net and existing court structures. This invention wraps under a standard tennis net forming a double sided ball-catching device which utilizes brackets to expand the sides and to attach the catch-net to the standard net posts. This ball-capturing net device catches errant tennis balls which would otherwise strike the standard tennis net and rebound back onto the playing surface causing the player(s) potential injury or interruption of play. This invention is designed to be used for instructional, recreational, and competitive tennis.

2. Prior Art

There are several patents shown in the prior art. While the basic structure of catching apparatus for receiving tennis balls off of a net is taught in prior art, the present specification addresses a novel method of structuring a ball-catcher so that it may be attached to an existing net with a minimum amount of expense and a minimum amount of time in order to make the use of the product a more viable undertaking.

The problem of the prior technology is that it either requires a specialized net and/or accessories to be produced or it requires a complex and unworkable solution and as a result this type of technology has not been widely accepted or produced.

The present invention seeks to improve on this by providing a catch-net which may be attached to existing tennis court structures and later be removed quickly and easily or attached to existing tennis court structures and left permanently. It is also a purpose to provide for a net which is easily stored.

Several patents in the prior art show mechanisms retaining balls at a tennis net. The most pertinent prior art in this case from the cite prior art includes the Langslet Patent '268, the Moore Patent '715, the Clark Patent '376, the Zak Patent '711 and the Thaxton Patent '547.

The Langslet Patent shows a ball-capturing tennis net assembly which has similar features to this patent. However, Langslet has specified using either two separate nets or one continuous net looped around (not under) the standard tennis net with end and middle brackets designed to hold the catch-net away from the standard tennis net.

The '715 Patent shows essentially the same technology wherein a catch-net is located on either side of a standard tennis net although there is negligible separation between the catch-net and the main net.

The Thaxton, Zak and Clark Patents show similar mechanisms in the prior art including the use of multiple catch nets to the same end.

3. BRIEF SUMMARY OF THE INVENTION

This invention, the ball-capturing tennis net assembly, consists of four major pieces: two end brackets which are attached to the standard net posts on either side of a standard tennis net, a ball-catching net which extends across the length of the court under the standard tennis net and/or attached to the standard tennis net, and at least one center spacer unit which is attached to the ball-catching net. It is possible to have two or more center spacer units.

To assemble the ball-catching net apparatus the end brackets are attached to each standard net post. Next, the standard tennis net center clip is detached from the tennis court. The ball-capturing net is extended across the tennis court and centered flat on the court under the standard tennis net. There is a hole in the center of the catch-net through which the center clip will later be re-attached to the tennis court. The v-shaped members (the middle brackets) of the center spacer unit are assembled by inserting a cross-bar piece from each of the at least two middle brackets into one another and attaching said assembled center spacer unit to the ball-capturing net. The attachment of the center spacer unit to the catch-net may be by way of straps from the capturing net to the center spacer unit and/or through holes in the ball-capturing net into which extensions from the center spacer unit enter or by way of holes in the ball-capturing net into which stabilizing legs from the center spacer unit fit. Next, the top bars of (or the alternate top tubes of) each of the middle brackets of the center spacer unit are attached to the catch-net inner attachment bindings. These inner attachment bindings may also be straps from the capturing net or holes in the capturing net into which the top bars fit. Next, the center clip of the standard tennis net is re-clipped onto the tennis court through the hole in the center of the catch-net. Finally, the end and side adjustable end straps protruding from each end of the capturing-net are attached to the end brackets and tightened.

Where more then one separate center spacer unit is used, a crossbar piece may be used to connect the separate center spacers together or they may be independent from other center spacer units.

The end brackets and the middle brackets of the center spacer unit are designed to bold the side bindings 33 of the catch-net parallel to and at a pre-determined width from each side of the net. This is accomplished by having each end bracket top arm and the middle bracket top arms at a desired height and width from each other.

The specification shows a combination of brackets and netting which may be easily attached to an existing standard tennis net in order to catch tennis balls which hit the net. In order to accomplish this a catch net which is preferably approximately 25" wide is attached underneath/or to an existing standard net so that approximately 12" of netting protrude on either side of the standard net at an angle bisecting the perpendicular plane of the standard net and tennis court. This catch-net preferably extends along the entire length of the standard net. End brackets are attached to both the net posts and the catch-net and one or more center spacer units are attached to the catch-net. These end brackets and the middle brackets of the center spacer unit(s) are designed to receive straps or other attachment means from the catch-net so that the netting is held in a v-shape under and around the existing standard net.

The novel design and function of the catch-net and brackets allows for anyone to quickly attach and remove the catch-net if they do not own the court; however, this design may also be incorporated into a standard net to provide a permanent net system for tennis courts with a built in catch-net by sewing the catch-net to the standard tennis net.

The invention reduces the likelihood of injury by reducing the number of balls which would be present on the court.

The invention also allows for the balls to be more easily collected.

It is therefore an object of the invention to provide a catch-net for the standard tennis net which can collect tennis balls which strike the standard tennis net preventing them from entering the area of play.

It is a further object of the invention to reduce injuries by reducing the number of tennis balls which are on the court during play.

It is yet another object of the invention to provide a catch-net which can be used in instructional, recreational, and competitive tennis.

These and other objects and advantages of the invention will become better understood hereinafter from a consideration of the specification with reference to the accompanying drawings forming part thereof, and in which like numerals correspond to part throughout the several views of the invention.

BRIEF DESCRIPTION OF THE SEVERAL VIEWS OF THE DRAWING

For a further understanding of the nature and objects of the present invention, reference should be made to the following detailed description taken in conjunction with the accompanying drawings in which like parts are given like reference numerals and wherein:

FIG. 8 shows a detail of one of the end brackets as attached to the net post 13 with catch-net 15 shown in position.

FIG. 9 shows a top view of the end bracket shown in FIG. 8.

FIG. 10 shows an end piece bracket with an alternate attachment means.

FIG. 11 shows two middle brackets of the "floating" center spacer unit assembled.

FIG. 12 shows a top view of the middle brackets of the center spacer unit shown in FIG. 11 as attached to both the catch-net 15 and the standard tennis net 11 for a catch-net layout as shown in FIGS. 3 and 5.

FIG. 13 shows an alternate embodiment of one middle bracket of FIG. 11 for a net layout such as is shown in FIG. 4 and 6.

FIG. 14 shows a perspective view of the middle brackets of the center spacer unit of FIG. 13 after assembly.

DETAILED DESCRIPTION OF THE INVENTION

Figure 1:
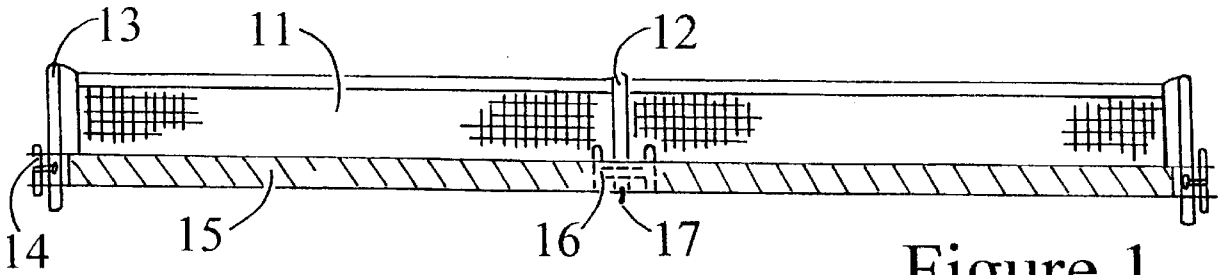
FIG. 1 shows a plan view of the invention installed on a standard tennis net.
Figure 5:
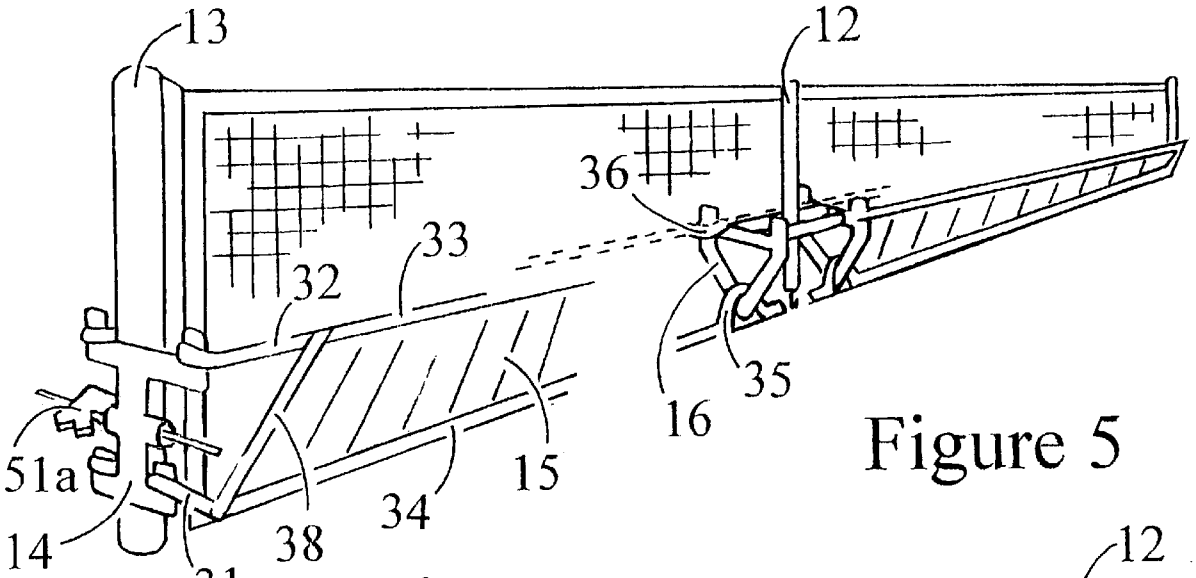
FIG. 5 shows a plan view from one side showing the operative features of the catch-net assembly.
Figure 6:
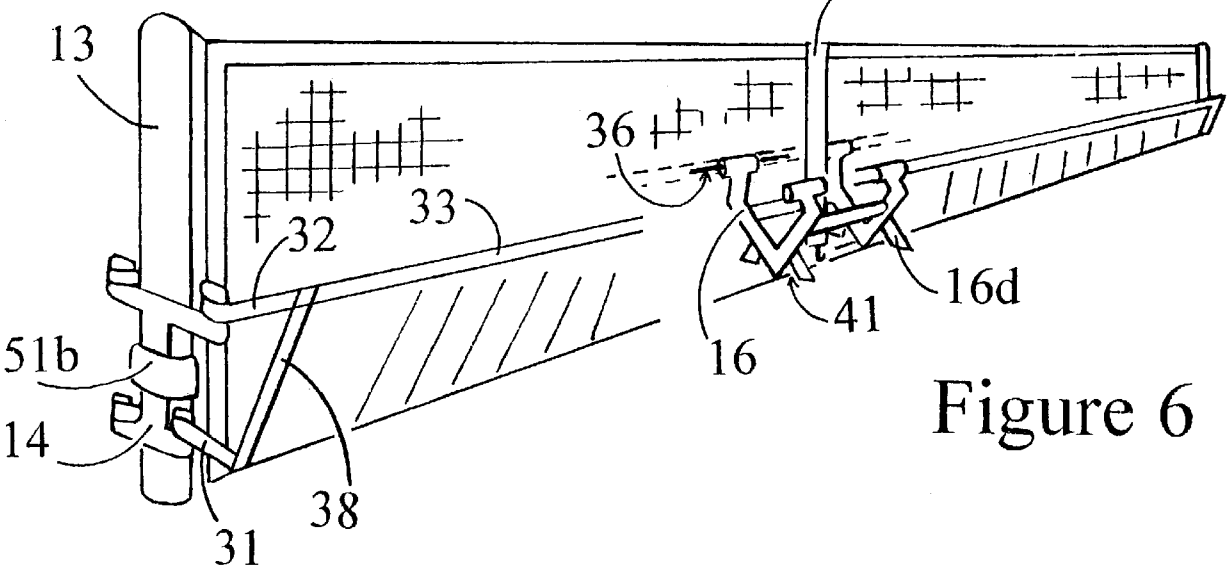
FIG. 6 shows a plan view from one side showing the operative features of an alternative catch-net assembly.
Figure 16:
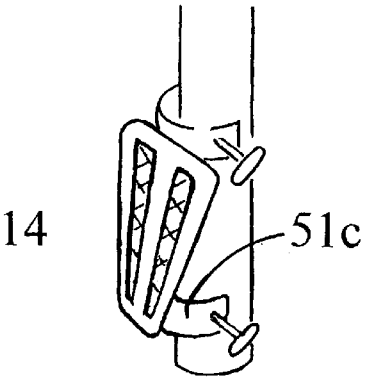
FIG. 16 is a side view of the end bracket in FIG. 15.

FIG. 1 shows the standard tennis net 11, center net strap 12, and net posts 13. Attached to the net posts are the ball-capturing assembly end brackets 14, the catch net 15, and a center spacer unit 16. The standard center net strap is attached to the court with a center net clip 17. FIG. 1 shows the use of a catch-net assembly having end brackets 14 and a center spacer unit 16 designed to hold the catch-net 15 in an open position. The catch-net may be set up with or permanently attached to a standard tennis net 11. The end brackets 14 are mounted to the net posts with one or more attaching means which may be any type of attaching means known in prior art including (but not limited to) hook and loop fasteners, cords, buckles, elastic straps, screws, clamps (such as 51 and 51*c* as seen in FIGS. 5, 9, and 16) or straps 51*b* (as seen in FIGS. 6 and 10). The existing center net strap 12 is attached to the court with a center net clip 17. The tennis net 11 is held tightly to the tennis posts 13 on either side in a manner well known in the prior art. The center spacer unit 16 either "floats"0 under the tennis net 11 or has stabilizing legs 16*d* (FIGS. 5 & 6) which rest on the tennis court.

Figure 2:
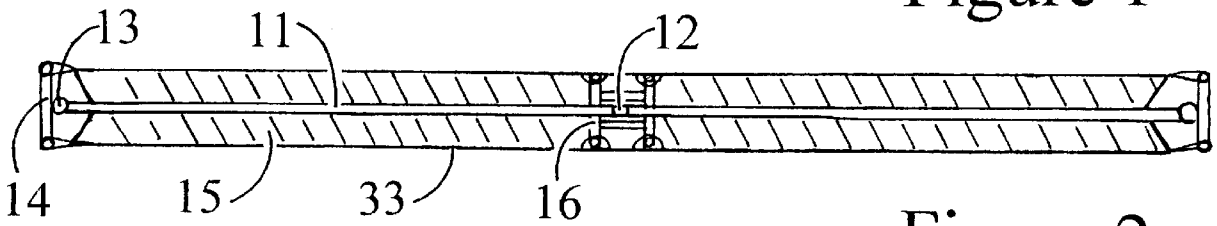
FIG. 2 is an overhead view of the installation shown in FIG. 1.

FIG. 2 shows a top view of the layout shown in FIG. 1 where the catch-net 15 can be seen open on either side of the tennis net 11. The side bindings 33 are held nearly parallel to the standard tennis net while the bottom of the catch-net is held closely to the standard tennis net bottom forming a v-shaped pocket around the standard tennis net (as seen in side views in FIG. 5 & 6 and cross-section in FIG. 8). There is no opening to the tennis court along either side of the standard tennis net other than small functional holes in the catch-net.

Figure 3:
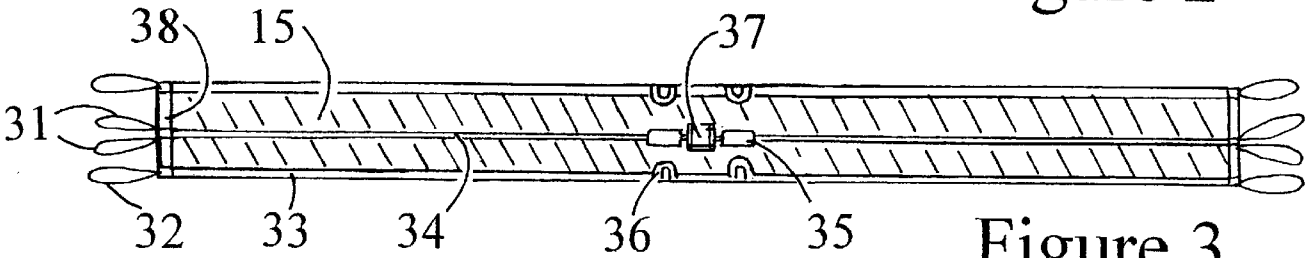
FIG. 3 shows the catch-net laid out in a flat position.

FIG. 3 shows an embodiment of the catch net laid out in a flat position which is shown with details in FIG. 5 in an assembled position. The catch-net 15 is broken into two sides which are identical. The two sides of the catch-net 15 are separated by a center binding 34. Each end of the catch-net is reinforced with an end binding 38. Attached to the end bindings 38 and side bindings 33 there are center adjustable end straps 31 and side adjustable end straps 32 which, when assembled, will protrude from the bottom and top (respectively) of the catch net providing a tension system for the catch net. The side bindings 33 become the top edge of the catch-net 15 when assembled. There is a reinforced center hole 37 which makes it possible for the tennis net center clip 17 to be attached through the catch-net and onto the tennis court. On either side of the center hole 37 are center spacer bindings 35 which serve to hold the bottom of the v-shaped members of the middle brackets of the center spacer unit in place. Adjacent to the side bindings 33 on either side of the center hole 37 are inner attachment bindings 36 used to attach the center spacer unit to the top of the catch-net which are also described in more detail in reference to FIGS. 17, 18 and 19 below.

Figure 4:
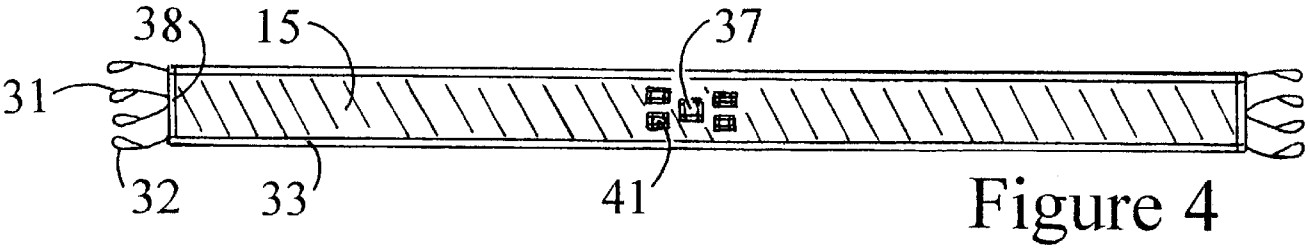
FIG. 4 shows another embodiment of the catch-net laid out in a flat position.

FIG. 4 shows an alternate embodiment of the catch-net laid out in a flat position which is shown with details in FIG. 6 in an assembled position. Near the four sides of the center hole 37 are center spacer holes 41 through which the center spacer unit stabilizing legs 16*d* will fit (see FIGS. 14, 18, and 19) and which will be described in more detail below. The catch net 15 shown has no center binding. It shows a catch net 15 with alternative tensioning means comprised of center and side adjustable end straps 31, 32 and an alternative means for attaching the center spacer assembly through center spacer holes 41. The top of each side 15 of the catch-net has a side binding 33. Each of the side bindings 33 end in a side adjustable end strap 32. Attached to the end bindings 38 are center adjustable end straps 31. These center and side adjustable end straps are designed in any way known in the prior art (elastic straps, straps with buckles, cooperating hook and loop fasteners, etc.) so that the slack in each strap may be taken up in order to tighten the ends of the catch-net 15.

As can be seen by reference to FIGS. 5 & 6 the catch-net 15 itself is designed to form a two-sided net which protrudes on either side of the standard net from a point under and in close proximity to the bottom of the standard tennis net 11 and towards the top of the standard tennis net 11 at an angle near 45 degrees on each side, forming a v-shaped catch-net. The length of each catch-net side from the center of the standard tennis net 11 is typically about one third of the height of the standard tennis net in order to assure that the tennis balls which are hit into the standard tennis net are caught.

Easy installation of the invention is ensured by the design of the two end brackets 14 and the middle brackets of the center spacer unit 16. The center spacer unit brackets are cooperatively attached to the center area of the catch-net and side binding 33 to secure the catch-net open.

As can be seen by reference to FIG. 5, in this embodiment center spacer bindings 35 can be seen passing from the center binding 34 over the v-shaped member 16*a* (part of the middle bracket) of the "floating" center spacer unit 16 and then back to the center binding 34, thereby securing the bottom of the v-shaped member 16*a* in place along the center binding 34. The inner attachment bindings 36 can be seen running from the side bindings 33 over the top bars 16*b* of the center spacer unit 16 and back to the side bindings 33 to hold the side bindings 33 out from the standard tennis net 11 (details can be seen in FIGS. 11 and 12). Here, one or more of these center spacer units 16 may be used, although one is shown here.

FIG. 6 shows an alternative construction of the center spacer unit 16, utilizing the same end brackets 14. The catch-net design differs here from the design in FIG. 5 because stabilizing legs 16*d* from the center spacer unit fit through the openings 41 in the catch-net 15. If more than one center spacer unit 16 is used, more holes 41 would be required in the catch-net 15. In this preferred embodiment (see FIGS. 13 and 14) each middle bracket consist of only two separate pieces, the v-shaped member 16*a* and the cross bar 16*c*. The top bar 16*b* has been replaced with two tubes 16*g* which are attached to the v-shaped member 16*a* at the top ends, each having a hole 16*f* through which the inner attachment bindings 36 will pass and be reconnected to the side bindings 33. (Also see FIGS. 18, and 19.)

Figure 7:
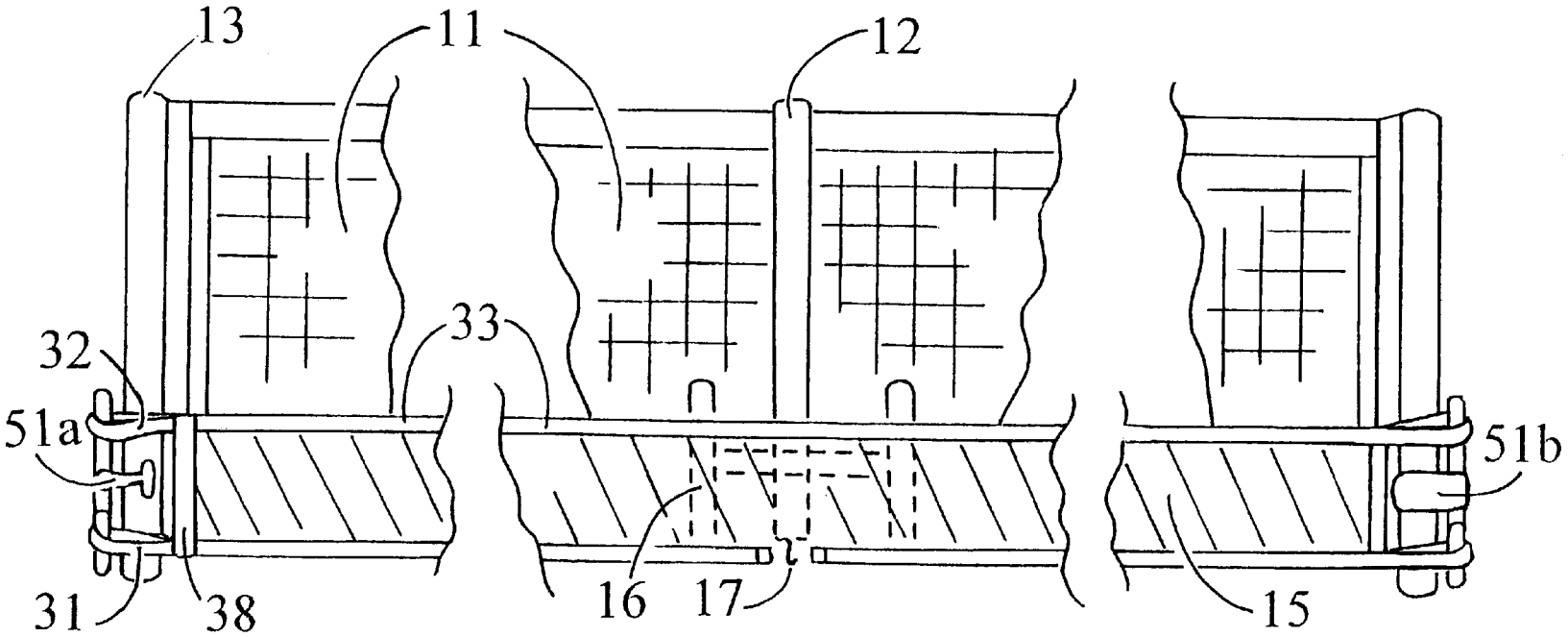
FIG. 7 shows a detail of the end portions and the middle portion of the catch-net assembly.

FIG. 7 shows a close-up side view of the catch-net with different types of attachments 51*a* and 51*b* holding the end brackets 14 to the standard net posts.

FIG. 8 shows an end bracket 14 attached to the standard net post 13 with catch-net 15 shown in position. The attaching means for the end bracket 14 depicted here is a clamp 51*a* (although other attaching means can be used with this invention). The end bracket 14 is described in more detail in FIG. 10. Attached to the end bracket 14 are the center adjustable end straps 31 and the side adjustable end straps 32 which protrude from the end of the catch-net 15 and provide a tensioning system to the catch-net 15. The center and side adjustable end straps 31 and 32 also help to hold the end bracket 14 against the net post 13.

FIG. 9 shows a top view of the end bracket 14 attached to the net post 13 where the clamp 51*a* can be seen on either side of the net post 13 and the center and side adjustable end straps 31 and 32 can be seen with their relative spacing to hold the catch-net 15 open as shown. The side bindings 33 become the top of the sides of the catch-net 15 and are held parallel to the standard tennis net 11.

FIG. 10 shows an end bracket with an alternate attachment means of a strap 51*b*. The end bracket 14 has a top arm 14*a* and a shorter bottom arm 14*b* which are held perpendicular to and extend outward from the side of the net post when assembled (see FIG. 8). Both the top arm 14*a* and the bottom arm 14*b* have protrusions on each end 14*c* and 14*d* respectively which extend upward from the ends of these bars a desired distance in order to securely hold the center and side adjustable straps 31 and 32 in place. The center adjustable end straps 31 are attached to the bottom arm protrusions 14*d* and the side adjustable end straps 32 are attached to the top arm protrusions 14*c* (see FIG. 8). The arms 14*a* and 14*b* are joined together by the main arm 14*e* which runs parallel to the net post and may contain one or more tubes 14*f* which serve to hold the attachment means.

FIG. 11 shows one embodiment of a center spacer unit 16 (see FIG. 5 and FIG. 12 for unit with assembled catch-net). The center spacer unit 16 is made of two middle brackets. Each middle bracket has a bottom v-shaped member 16*a*, a top arm 16*b*, and a cross bar 16*c*. In this embodiment the v-shaped member 16*a* is attached to the bottom of the catch-net 15 by a center spacer binding 35, the top arm 16*b* is fed through the netting of the standard tennis net and is then attached to the bottom member 16*a*. Each middle bracket contains at least two holes in which the cross bars 16*c* are fit (when assembled the cross bars 16*c* in this embodiment run parallel to the standard tennis net 11). Two joined middle brackets (containing parts 16*a*, 16*b*, and 16*c* in this embodiment) form the center spacer unit 16.

FIG. 12 is a top view of an assembled center spacer unit 16 shown in FIG. 11 after it is attached to the inner attachment bindings 36 of the catch-net 15 which helps to hold the side bindings 33 parallel to and a desired distance away from the standard tennis net 11 shown at the area of the center net strap 12.

Figure 17:
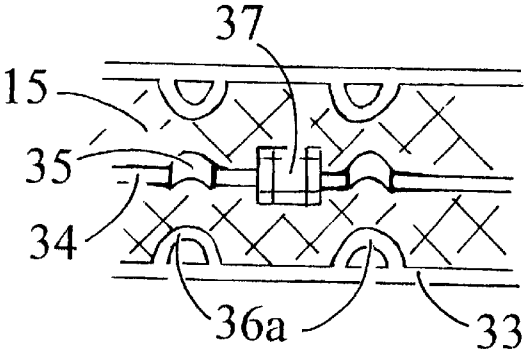
FIG. 17 shows a close-up view of the central bindings and central hole of the catch-net shown in FIGS. 3 & 5 using a center spacer unit as shown in FIGS. 11 & 12.
Figure 18:
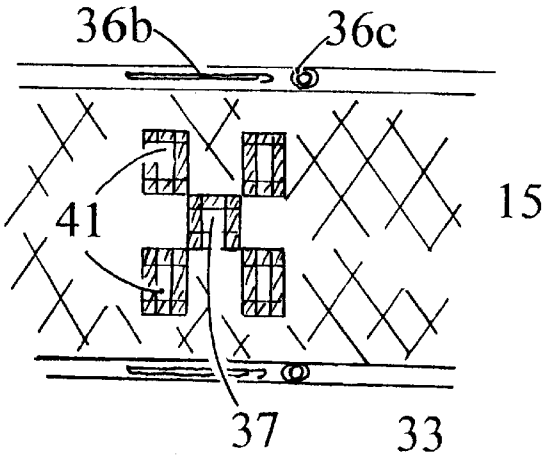
FIG. 18 shows a detailed view of the catch-net center portion embodying the layout shown in FIGS. 4 & 6 using a center spacer unit as shown in FIGS. 13 & 14.
Figure 19:
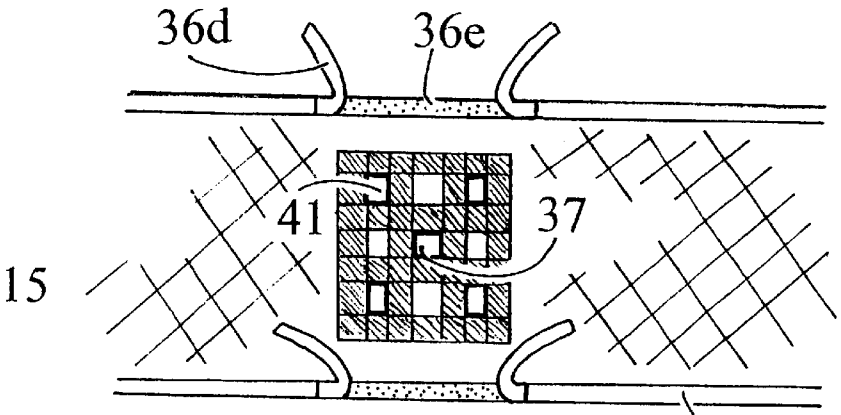
FIG. 19 shows a detailed alternate view of the catch-net center portion embodying the layout shown in FIGS. 4 & 6 using a center spacer unit as shown in FIGS. 13 & 14.

It should be noted in connection with this that in one embodiment the center spacer bindings 35 and the inner attachment bindings 36 are used to attach the center spacer (FIG. 5 and 17). Whereas, in another embodiment there are inner attachment bindings 36 and holes 41 for the stabilizing legs 16*d* to pass through as seen in FIGS. 6, 18 and 19.

FIG. 13 shows details of an alternate middle bracket of the center spacer unit 16 disassembled. Each middle bracket in this preferred embodiment consists of only two separate pieces: the v-shaped member 16*a* and the cross bar 16*c*. The top bar 16*b* has been replaced by a top tube 16*g* (see FIG. 14) which is attached to the v-shaped member 16*a* permanently and is held parallel to the standard tennis net. These top tubes 16*g* have holes l6*f* through which the inner attachment means 36 pass and secure the top edges of the catch-net to the center spacer unit. This view shows the v-shaped member 16*a*, with two stabilizing legs 16*d*, and a cross bar 16*c* which fits into a hole 16*e* to connect the two middle brackets together.

FIG. 14 shows the preferred embodiment of the center spacer unit assembled. The middle brackets of this embodiment have only two separate pieces, the v-shaped member 16*a* and the cross bar 16*c* which fits into the holes 16*e* to connect the middle brackets of the center spacer unit together. Note that the top bar 16*b* (from FIGS. 11 and 12) is now replaced with an alternate top tube 16*g* and is attached to the top ends of the v-shaped member 16*a*, running parallel to the standard tennis net. The top bar 16*b* is replaced with an alternate tube 16*g* which has an opening 16*e* to receive the inner attachment bindings 36 to hold the catch-net side bindings 33 open.

As can be seen by reference to FIG. 14, stabilizing legs 16*d* are built onto a v-shaped center spacer 16 and these legs will fit through reinforced leg holes 41 and stand on the court as shown in FIG. 6. The tennis net center clip 17 will continue to go through the reinforced center hole 37 in the catch-net 15 to hold the tennis net 11 down at the center. There are various means to connect the top tubes 16*g* (or the alternate equal of top arms 16*b*) to the inner attachment bindings 36 on the catch-net. In the preferred embodiment one or more straps 36 (made of elastic, Velcro, bungee, etc.) would be attached to the side bindings 33 and from there pass through both openings 16*f* in the right side top tubes 16*g* and reattach to the side bindings 33. Another strap (or straps) 36 would go through the left side top tubes 16*g* in the same fashion. See FIGS. 14, 18 and 19.

Figure 15:
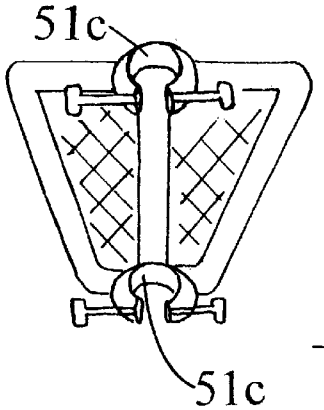
FIG. 15 is an alternate version of the end brackets shown in FIGS. 8, 9 and 10 with two attachment points 51*c*.

FIG. 15 is yet another embodiment of an end piece bracket 14 shown with two alternate attachment means 51*c*.

FIG. 16 shows a side view of FIG. 15 as attached to the net post 13.

FIG. 17 shows details for the catch-net attachments to the center spacer unit. The catch-net has a center hole 37 and running along the center binding 34 it has inner attachment straps 35 which hold the bottom of this "floating version" of the center spacer unit in place. There are also inner attachment binding straps 36*a* shown which wrap around the top bars 16*b* of the center spacer unit and hold the catch-net in position. See FIGS. 5,11 and 12 also.

FIG. 18 shows details for the catch-net shown in FIG. 4 used with center spacer unit(s) shown in FIGS. 6, 13 and 14. In this figure the inner attachment binding 36 is made of a bungee-type cord with a hook 36*b* which passes through the top holes 16*f* in the top tubes 16*g* of the center spacer unit 16 and are then attached to a grommet 36*c* to hold the side bindings 33 of the catch-net 15 in position.

FIG. 19 is another version of FIG. 18 where the inner attachment bindings 36 are made of hook and loop straps 36*d* and 36*e* as an alternate attachment means for the center spacer unit 16. Also shown is a different embodiment for the center net area where the center area has the same hole configuration but a different binding configuration around the holes.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A combination of a catch-net assembly for catching balls which strike a tennis net with standard tennis court structures including the court surface, the net posts and the standard tennis net, wherein said catch-net assembly comprises:

A) an auxiliary catch-net attached to or held under and in close proximity to the bottom of the standard tennis net, said auxiliary catch-net extending under and onto each side of the court divided by the standard tennis net, forming a two sided structure, said auxiliary catch-net having attachment means which protrude from it, said auxiliary catch-net having at least one hole through it for providing attachment means; and B) auxiliary brackets designed to receive said attachment means from the auxiliary catch-net, said auxiliary brackets also designed to hold the auxiliary catch-net in a v-shaped position under and onto each side of the court divided by the standard tennis net, said auxiliary brackets being of two types:

a) middle brackets which function to receive said attachment means from the auxiliary catch-net and to hold the auxiliary catch-net in a v-shaped position, each said middle bracket having at least one cross bar for providing attachment to at least one other middle bracket, and b) end brackets which function to receive said attachment means from the ends of the auxiliary catch-net near each net post and to hold the auxiliary catch-net in a v-shaped position, said end brackets also having attachment means to the net posts.

2. The combination catch-net assembly as in claim 1 wherein:

A) each side of said two sided structure of said auxiliary catch-net is a mirror image of the other side, B) each side of said auxiliary catch-net protrudes upward from the bottom of the standard tennis net and outward onto each side of the court divided by the standard tennis net to a desired height and width, C) each side of said auxiliary catch-net forms a plane which protrudes from the bottom of the standard tennis net upward at an angled near 45 degrees to a height lower than the height of the standard tennis net, D) each side of said auxiliary catch-net extends across the court surface along the length of the standard tennis net between the two net posts, E) each side of said auxiliary catch-net is held in position by attachment means which extend from it and by at least one hole through it, and F) each side of said auxiliary catch-net is attached to auxiliary brackets which function to hold the auxiliary catch-net in position under and onto each side of the court divided by the standard tennis net.

3. The combination catch-net assembly as in claim 2 further comprising an auxiliary catch-net made of sufficiently small netting to hold a tennis ball, said auxiliary catch-net including:

A) side and end bindings made of appropriate materials,

B) attachment means on the side and end bindings designed to hold the auxiliary catch-net to the auxiliary brackets and to hold the auxiliary catch-net in position, C) central bindings made of appropriate materials, D) attachment means near the center of the auxiliary catch-net designed to hold the auxiliary catch-net to the auxiliary brackets and to hold the auxiliary catch-net in position, and E) at least one hole bound with appropriate materials located near the center of the auxiliary catch-net designed to hold the auxiliary catch-net in position.

4. The combination catch-net assembly as in claim 3 wherein the auxiliary catch-net unassembled has a rectangular shape consisting of two long sides bound with appropriate side binding material and two short sides bound with appropriate end binding material and wherein said auxiliary catch-net assembled has a different configuration wherein:

A) each of said side bindings form the top of each side of the auxiliary catch-net, said side binding extends a length of and is held parallel to a corresponding side of the court divided by the standard tennis net and held at a desired height and width, said side bindings having;

a) attachment means extending from each corner for attachment to a corresponding end bracket, and b) attachment means extending from a said side binding for attachment to a corresponding middle bracket; and B) each of said end bindings forms one end of the auxiliary catch-net, said end bindings are held in a v-shape under and onto each side of the court divided by the standard tennis net wherein:

a) the center of each end binding corresponds to a bottom of the v-shape which is held under or attached to the standard tennis net bottom near a net post, and b) each top edge of the v-shape corresponds to the outer edges of the end binding, each said top edge is located on a side of the court divided by the standard tennis net near a net post and is held at a desired height and width.

5. The combination catch-net assembly as in claim 4 wherein the auxiliary catch-net in an alternate embodiment has a center binding running from the center of one end binding to the center of the other end binding, said center binding is parallel to and equidistant from the side bindings, said center binding is located along the bottom edge of the standard tennis net and has attachment means to the middle brackets near the center of the auxiliary catch-net.

6. The combination catch-net assembly as in claim 4 where the auxiliary catch-net has attachment means protruding from it wherein:

A) the attachment means are adjustable and allow for a tensioning system, and

B) the attachment means are received by and held to the auxiliary brackets.

7. The combination catch-net assembly as in claim 6 where the auxiliary catch-net has at least two attachment means extending from near the center of each end binding for attachment to an end bracket.

8. The combination catch-net assembly as in claim 1 having at least two end brackets where at least one end bracket is attached to each net post, each said end bracket having:

A) at least one attachment means to a net post, and

B) at least one arm extending perpendicular to the standard tennis net plane and outward horizontally from each side of a net post, said arm having receiving means for the attachment means which extend from the auxiliary catch-net.

9. The combination catch-net assembly as in claim 8 wherein each end bracket comprises:

A) a top arm extending perpendicular to the standard tennis net plane and outward horizontally from each side of a net post, a) said top arm having a protrusion on each distal end to receive and hold a top attachment means which extends from the top corners of the auxiliary catch-net where the side and end bindings meet, b) said protrusions extending upwardly from a top edge of each end of a top arm to a desired height; and B) a bottom arm extending perpendicular to the standard tennis net plane and outward horizontally from each side of a net post, a) said bottom arm having a protrusion on each distal end to receive and hold a bottom attachment means which extends from a center of the catch-net end binding near the bottom of the standard tennis net, b) said protrusions extending upwardly from a top edge of each end of a bottom arm to a desired height; and C) a main arm connecting a top arm and a bottom arm which extends vertically along the side of a net post.

10. The combination catch-net assembly as in claim 1 including at least two middle brackets which are connected together by cross bars to form a center spacer unit, each center spacer unit located between the net posts near the center of the auxiliary catch-net and each said center spacer unit comprised of.

A) two v-shaped middle brackets which extend under and onto each side of the court divided by the standard tennis net, each middle bracket held perpendicular to the plane of the standard tennis net wherein each said middle bracket:

a) is held closely to the bottom of the standard tennis net at the bottom of v-shape by attachment means from the bottom of the auxiliary catch-net, b) is held at a desired height and width from the standard tennis net at the top edges of the v-shape, said top edges of the v-shape being located on a side of the court divided by the standard tennis net, c) has receiving means for receiving the attachment means extending from the side bindings of the auxiliary catch-net, d) has at least two holes as receiving/connecting means for the cross bars which are used to connect the middle brackets together; and B) at least one cross bar per middle bracket, each said cross bar having two ends, each end inserted into opposing holes in like but opposing middle brackets, said cross bar used to stabilize and connect the middle brackets together, each cross bar running parallel to the standard tennis net.

11. The combination catch-net assembly as in claim 10 wherein each middle bracket of the center spacer unit also includes:

A) two stabilizing legs per middle bracket, each stabilizing leg protruding at an angle downward from an arm of the v-shape, each said stabilizing leg passing through a hole near the bottom of the auxiliary catch-net designed for this purpose, each stabilizing leg resting on the tennis court near the bottom of the standard tennis net, and B) two top tubes for receiving the attachment means from the auxiliary catch-net, each top tube attached to a top edge of the v-shape of each middle bracket and each top tube located on a side of the court divided by the standard tennis net, each top tube running parallel to the standard tennis net and encompassing a hole through which the attachment means from a side binding of the auxiliary catch-net will pass and then be reconnected to the auxiliary catch-net side binding.

12. The combination catch-net assembly as in claim 11 wherein the auxiliary catch-net attachment means also includes at least four holes appropriately bound near the center of the auxiliary catch-net, each said hole corresponding respectively to a stabilizing leg of a middle bracket of a center spacer unit where said stabilizing legs extend through said holes to fix the location of the auxiliary catch-net and to allow for an overall v-shape.

13. The combination catch-net assembly as in claim 10 where each middle bracket in an alternate embodiment includes a top bar for receiving the attachment means from the auxiliary catch-net, said top bar extending through the mesh of the standard tennis net and connected to the top edges of the v-shape of the middle bracket, said top bar having protrusions extending upward from the top edge of each distal end to a desired height to receive the attachment means from the auxiliary catch-net.

* * * * *